US011633658B2

(12) United States Patent
Raber

(10) Patent No.: US 11,633,658 B2
(45) Date of Patent: Apr. 25, 2023

(54) WEIGHTLIFTING BARBELL ROLLER AND SYSTEMS AND METHODS FOR USING THE SAME

(71) Applicant: Jeremiah Raber, High Ridge, MO (US)

(72) Inventor: Jeremiah Raber, High Ridge, MO (US)

(73) Assignee: Jeremiah Raber, High Ridge, MO (US)

( * ) Notice: Subject to any disclaimer, the term of this patent is extended or adjusted under 35 U.S.C. 154(b) by 420 days.

(21) Appl. No.: 17/006,181

(22) Filed: Aug. 28, 2020

(65) Prior Publication Data

US 2022/0062732 A1 Mar. 3, 2022

Related U.S. Application Data

(60) Provisional application No. 62/894,055, filed on Aug. 30, 2019.

(51) Int. Cl.
*A63B 71/00* (2006.01)
*A63B 21/072* (2006.01)
*A63B 21/00* (2006.01)

(52) U.S. Cl.
CPC ..... *A63B 71/0054* (2013.01); *A63B 21/0724* (2013.01); *A63B 21/4035* (2015.10); *A63B 2071/009* (2013.01); *A63B 2208/0204* (2013.01)

(58) Field of Classification Search
CPC ..... A63B 21/0724; A63B 21/4035; A63B 21/4049; A63B 71/0054; A63B 2071/009; A63B 2208/0204
See application file for complete search history.

(56) References Cited

U.S. PATENT DOCUMENTS

| | | | | |
|---|---|---|---|---|
| 4,455,020 | A * | 6/1984 | Schnell | A63B 21/0728 482/106 |
| 5,152,731 | A * | 10/1992 | Troutman | A63B 21/0724 482/106 |
| 7,086,999 | B2 * | 8/2006 | Jeneve | A63B 21/015 482/141 |
| 9,375,601 | B2 * | 6/2016 | Miller | A63B 21/0724 |
| 9,522,298 | B2 * | 12/2016 | Siemer | A63B 21/4035 |
| 9,889,329 | B2 * | 2/2018 | Ernst | A63B 21/055 |
| 2006/0276314 | A1 * | 12/2006 | Wilson | A63B 21/015 482/106 |
| 2013/0029810 | A1 * | 1/2013 | Olivencia | A63B 71/1225 482/93 |
| 2017/0319894 | A1 * | 11/2017 | Ernst | A63B 21/055 |

* cited by examiner

*Primary Examiner* — Joshua Lee
(74) *Attorney, Agent, or Firm* — Lewis Rice LLC

(57) ABSTRACT

Systems and methods for reducing injury sustained during weightlifting and for making deadlifting more comfortable by encouraging correct form with reduced risk of injury. Specifically, this disclosure relates to systems and methods for reducing injury during a deadlift by providing a cushioned, free-spinning roller protective device on an associated barbell which roller is configured to roll relative to the barbell so that contact between the roller and the users leg results in the barbell bar rolling along the leg.

17 Claims, 4 Drawing Sheets

WEIGHTLIFTING BARBELL ROLLER AND SYSTEMS AND METHODS FOR USING THE SAME

CROSS-REFERENCE TO RELATED APPLICATIONS

This application claims the benefit of U.S. Provisional Patent Application Ser. No. 62/894,055, filed Aug. 30, 2019, the entire disclosure of which is herein incorporated by reference.

BACKGROUND OF THE INVENTION

Field of the Invention

This disclosure is related to the field of exercise equipment. More particularly, this disclosure is related to a roller designed to be placed on or around a weightlifting barbell to protect a weightlifter and provide sanitary conditions for the weightlifter and weightlifting bar and methods of using the same.

Description of the Related Art

Weight training is a common type of strength training used to develop the strength and size of skeletal muscles. Weight training typically utilizes the force of gravity as resistance by providing weighted bars, dumbbells, weight stacks, or other sources of weight in order to oppose the force generated by muscle through concentric or eccentric contraction. Weight training often uses a variety of specialized equipment to target specific muscle groups and types of movement.

Humans have lifted weights since before recorded history. For example, in many prehistoric tribes, tribe members would have a big rock they would try to lift, and the first individual to lift the big rock would inscribe their name into the rock. Such rocks have been found in Greek and Scottish castles. Progressive resistance training dates back at least to Ancient Greece. For example, a known Greek legend holds that wrestler Milo of Croton weight trained by carrying a newborn calf on his back every day until it was fully-grown. Another historical Greek, the physician Galen, described in writings dating to the second century A.D. strength training exercises using an early form of a dumbbell. Ancient Greek sculptures also depict lifting feats. The weights being lifted were generally stones, but later works describe and show the use of dumbbells. Soon, the dumbbell was joined in the latter half of the nineteenth century A.D. by the barbell. These early barbells generally comprised hollow globes that could be filled with sand or lead shot, but by the end of the nineteenth century A.D., these globes were replaced by the plate-loading barbell commonly used today. Weightlifting was first introduced as a sport in the Olympics in the 1896 Athens Olympic Games as a part of the track and field events, and weightlifting was officially recognized as its own Olympic event in 1914.

Today, one of the most popular weightlifting exercises is the deadlift. Further, the deadlift is often recommended to trainees by weightlifting coaches. The deadlift is believed to use almost every muscle in the body and activate the posterior chain of muscles with an efficiency unmatched by other techniques. This is of a particular importance because many weightlifters look in the mirror during training and only train what they see in front of them, leading to the posterior muscles being neglected by many weightlifters.

Further, many people lead relatively sedentary lives that involve sitting for a majority of the day. This extended time spent sitting may allow an individual's gluteal muscles (or "glutes") to remain relatively inactive for much of the day. This inactivity may lead to underdevelopment of the glutes, which underdevelopment may result in poor form when the sedentary individual participates in any athletic activities, in part because the sedentary individual does not realize that the first muscles that should be firing during the athletic activity are often the glutes and hips. Typically, experienced weightlifters, strong people, and athletes understand that the posterior chain of muscles is the most important muscle grouping to focus on during weightlifting when attempting to develop increased personal power, speed, and strength. This is also true of weightlifters and athletes who are attempting to develop proper weightlifting and athletic form for various exercises and skills. Deadlifting is also a common competitive weightlifting activity.

Another issue is that many weightlifters do not understand how to attain proper form while deadlifting and, as a result, do not perform deadlift exercises correctly. Even though following proper deadlifting form is relatively simple, many fail. This is a problem, at least, because performing deadlifts improperly may cause injury to the weightlifter.

A standard deadlift is typically performed using a barbell. Barbells are typically designed to meet known standards set for barbell thicknesses and lengths. For a typical deadlift, a weightlifter would approach a barbell with weights loaded on each end of the barbell that rests on the ground. The weights am typically plate-shaped. The weightlifter will typically stand towards one side of the barbell near the middle of the barbell. Next, the weightlifter will typically squat down and grab the barbell with an overhand hook grip. At this moment, the person should look like they are doing a squat when viewed from the side. Then, the weightlifter will typically begin to lift the barbell while keeping the middle of the barbell pulled close to the weightlifter's shins. Nearly all of the weightlifter's muscles will then tighten as the weightlifter stands up with the barbell in hand. To follow proper form, the weightlifter's hips should not rise before the weightlifter's shoulders rise. It is believed to be a best practice to allow the weightlifter's hips and shoulders to raise at almost the exact same rate, with the shoulders moving first.

One often-encountered problem with a weightlifter's deadlifting form is that the weightlifter will hold the barbell away from the body, which form will create an improper fulcrum in the back and greatly increase the probability of a serious spinal injury. One reason that weightlifters tend to hold the barbell away from the body is that most weightlifters find that a heavy and hard (and often rough to improve grip) barbell may scrape their shins as it is held closely to the body and lifted. Unfortunately, ideal deadlifting form will often cause the barbell to rub against the weightlifter's shins during a lift. This contact between the barbell and the weightlifter's shins can cause discomfort for the weightlifter, even resulting in scrapes and cuts on the weightlifter's shins.

When lifting the barbell in the deadlift, the proper form is to pull the barbell back and up, which backward and up motion is an attempt to counter the weight of the weightlifter's body and the barbell pulling the weightlifter forward and down. This is due, in part, to range of motion limitations of the human body and the overall structural makeup of the human musculoskeletal system. Unfortunately, a weightlifter must manage the scrapes and cuts caused by the barbell to obtain the best deadlift form and to get the most benefit out of the deadlift exercise.

One prior art attempt at reducing shin scrapes and cuts is the use of thick knee-high socks that cover the shins and protect from some of the scraping. However, the protection provided by thick socks is limited. Repeated deadlifts or deadlifts using heavy weights will result in the same scrapes and cuts as if no socks are used.

The scrapes and cuts received during deadlifting also pose a further health problem. Specifically, cutting and scraping a weightlifter's skin opens up a pathway to communicate diseases, especially blood borne pathogens. For example, when a weightlifter uses a barbell and scrapes their shins on the barbell, the weightlifter may leave blood and other body materials on the barbell. This is particularly problematic where another weightlifter may use the same barbell, such as in a public gym. Although the barbell may be cleaned and disinfected between users, cleaning and disinfecting barbells does not always remove all pathogens and other unhealthy materials. Further, in some cases, the barbell may not be cleaned in between uses, even if only by accident. Another consideration is that during the deadlift, the weightlifter may embed pathogens in their legs when scraped or cut during the deadlift. In fact, any activity that causes open wounds to form or otherwise damages the skin has a potential to spread or cause an infection.

SUMMARY OF THE INVENTION

The following summary of the invention is provided to give the reader a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented in a later section.

Because of these and other problems in the art, this disclosure provides systems and methods for reducing injury sustained during weightlifting and for making deadlifting more comfortable by encouraging correct form with reduced risk of injury. Specifically, this disclosure relates to systems and methods for reducing injury during a deadlift by providing a cushioned, free-spinning roller protective device on an associated barbell which roller is configured to roll relative to the barbell so that contact between the roller and the users leg results in the barbell bar rolling along the leg.

There is described herein, among other things, a protective device for use with a barbell, the device comprising: a main body generally in the shape of a cylindrical shell having a primary axis, the main body including an inner hole along said primary axis configured for placement over a barbell; and a plurality of rollers positioned within said inner hole and configured to allow said main body to rotate about said barbell around said primary axis.

In an embodiment of the device, the rollers comprise bearings.

In an embodiment of the device, the rollers comprise wheels.

In an embodiment of the device, the main body can separate into two pieces, the plane of separation including said primary axis.

In an embodiment of the device, the two pieces snap together.

In an embodiment of the device, the two pieces are hinged together.

In an embodiment of the device, the lower layer of said cylindrical shell about said hole is a resilient material and the upper layer is a cushioned layer.

In an embodiment, the device further comprises two stabilizer ends, one of said two stabilizer ends being positioned at opposing ends of said cylindrical shell along said primary axis.

There is also described herein, in an embodiment, a protective device for use with a barbell, the device comprising: a main body generally in the shape of an hourglass having a primary axis, the main body including an inner hole along said primary axis configured for placement over a barbell; and a plurality of rollers positioned within said inner hole and configured to allow said main body to rotate about said barbell around said primary axis.

In an embodiment of the device, the rollers comprise bearings.

In an embodiment of the device, the rollers comprise wheels.

In an embodiment of the device, the main body can separate into two pieces, the plane of separation including said primary axis.

In an embodiment of the device, the two pieces snap together.

In an embodiment of the device, the two pieces are hinged together.

In an embodiment of the device, the lower layer of said cylindrical shell about said hole is a resilient material and the upper layer is a cushioned layer.

There is also described herein, in an embodiment, a barbell configured for use in a deadlift, the barbell comprising: two plate-loading portions with a grip portion therebetween; at least one weight plate loaded onto each of said plate-loading portions; and two protective devices positioned on said grip portion, each of said protective devices comprising: a main body generally in the shape of a cylindrical shell having a primary axis, the main body including an inner hole along said primary axis configured for placement over a barbell; and a plurality of rollers positioned within said inner hole and configured to allow said main body to rotate about said barbell around said primary axis.

In an embodiment of the barbell, the protective devices are positioned on said grip portion so as to contact a user's shins when said barbell is used in a deadlift.

In an embodiment of the barbell, the protective devices traverse at least a portion of said grip portion when said barbell is used in a deadlift.

In an embodiment of the barbell, the main body can separate into two pieces to separate said protective devices from said barbell, the plane of separation including said primary axis.

In an embodiment of the barbell, the protective devices are integrated into said barbell.

DETAILED DESCRIPTION OF PREFERRED EMBODIMENTS

Figure 1:
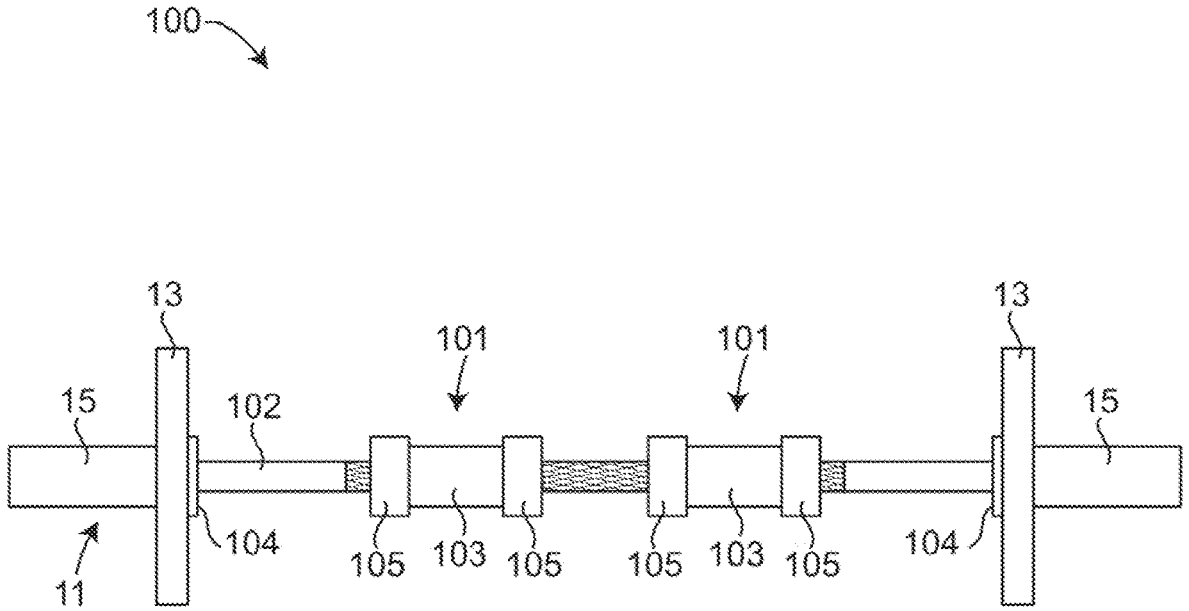
FIG. 1 depicts a side view of an embodiment of a system for reducing injury during a deadlift by providing a cushioned, free-spinning roller protective device on a related barbell as contemplated herein.

FIG. 1 depicts a side view of embodiment of a system (100) for reducing injury during a deadlift by providing a cushioned, free-spinning roller protective device (101) on a barbell (11) to be used in a deadlift exercise. FIG. 1 shows a barbell (11) having two plate-loading portions (15) on either end of the barbell (II), several weight plates (13) loaded onto the two plate-loading portions (15), and a grip portion (102) located between the two plate-loading portions (15).

As can be seen in the depicted embodiment, the barbell (11) has a generally linear and cylindrical shape. Typically, the grip portion (102) will have a textured surface. For example, the textured surface may be knurled. In some embodiments, the entire grip portion (102) is textured. In other embodiments, a central portion of the grip portion (102) may be free of any texture. In yet other embodiments, the entire grip portion may be free of texture. In the depicted embodiment, the plate-loading portions (15) are free of any texture. In other embodiments, the plate-loading portions (15) may have some texture or may be completely textured.

Typically, the plate-loading portions (15) will rotate independently from the grip portion (102). In some embodiments, a bushing is used between the plate-loading portions (15) and an extension of the grip portion (102) that extends through the plate-loading portions (15) to provide reduced friction rotation. In other embodiments, bearings may be used to allow the rotation. The extensions from the grip portion (102) may extend a full length through the plate-loading portions (15). In some embodiments, the extensions from the grip portion (102) will typically extend less than a full length through the plate-loading portions (15). In yet other embodiments, there are no extensions from the grip portion (102), and the grip portion (102) will be connected to the plate-loading portions (15) via a rotating or other interface. The barbell (11) may also comprise a very simple form, such as an elongated cylinder with no relative difference between the grip portion (102) and the plate-loading portions (15).

Generally, the plate-loading portions (15) will have a collar portion (104) separating them from the grip portion (102). The collar portions (104) of the plate-loading portions (15) will generally have a greater overall diameter than the remainder of the plate-loading portions (15). This allows for the weight plates (13) to slide onto and off the plate-loading portions (15) while also allowing the weight plates on opposite ends of the barbell (11) to be positioned at the same distance from the center of the barbell (11). In other words, the weight plates (13) may be pressed up to the collar portions (104) because the weight plates (13) will not be able to slide onto or beyond the collar portions (104). These collar portions (104), in turn, may ensure equal loading of the barbell, which may prevent unnecessary torque being applied by the weights along an axis perpendicular to the major axis of the barbell (11) through the center of the barbell (11).

In the depicted embodiment, the plate-loading portions (15) have a greater diameter than the grip portion (102). However, in other embodiments, the plate-loading portions (15) may have a lesser diameter than the grip portion (102). In yet other embodiments, the plate-loading portions (15) and the grip portion (102) may have any diameter, and their diameters may be the same or different. The barbell (11) may be formed of a material that is sufficiently strong to withstand repeated lifts with heavy weights while remaining sufficiently ductile to allow the bar to maintain its structural integrity through the stress of repeated lifts, which repetition may see the barbell (11) bending under the strain of weight repeatedly. Typically, metal alloys including without limitation steels are used to form the barbell (11).

The weight plates (13) will typically be separate components from the barbell (11). However, in some embodiments, the weight plates (13) may be integrated into the barbell (11). The weight plates will typically be formed into a plate or disk-like shape. However, any shape may be used to form the weight plates. The weight plates may have a hollow central portion that is designed to be slightly larger than the diameter of the plate-loading portions (15). This design may allow the weight plates (13) to be mounted onto the plate-loading portions (15). The weight plates (13) may be made from any material or from multiple materials.

In the embodiment of the system (100) for reducing injury during a deadlift depicted in FIG. 1 are two cushioned, free-spinning roller protective devices (101). In other embodiments, more or less cushioned, free-spinning roller protective devices (101) may be used. When multiple cushioned, free-spinning roller protective device (101) are used, they may be similar or different in their shape, size, construction, or other feature. In some embodiments, two cushioned, free-spinning roller protective devices (101) may be used that are the same. Typically, the length of the cushioned, free-spinning roller protective device (101) in the direction of the length of a related barbell (11) is 6 inches or more. In other embodiments, the length of the cushioned, free-spinning roller protective devices (101) in the direction of the length of a related barbell (11) is 10 inches or more. In yet other embodiments, the length of the cushioned, free-spinning roller protective devices (101) in the direction of the length of a related barbell (11) is 12 inches or more.

The cushioned, free-spinning roller protective devices (101) may have a generally cylindrical shape (when assembled) with an opening in the center (113) (depicted in FIGS. 2A-2E) that is also generally in the shape of a cylinder and along the primary axis of the roller device (101). In other words, the cushioned, free-spinning roller protective devices (101) may generally have a shape that is a right circular hollow cylinder, also known as a cylindrical shell. The central opening (113) inside of the cushioned, free-spinning rollers may allow the rollers to spin around the barbell (11) during use. In particular, when a weightlifter uses two cushioned, free-spinning roller protective devices (101), each may be positioned on the barbell (11) in locations on or near the grip portion (102) where the weightlifter's shins would normally contact the barbell (11) during a deadlift. Accordingly, the cushioned, free-spinning roller protective devices (101) will contact the weightlifter's shins during a deadlift. The friction between the weightlifter's shins and the cushioned, free-spinning roller protective devices (101) may cause the cushioned, free-spinning roller protective devices (101) to spin on the barbell (11) while rolling up the weightlifter's shins, thus preventing injury to the weightlifter's shins during a deadlift. Further, the cushioned, free-spinning roller protective devices (101) may traverse the barbell (11) during the deadlift.

In some embodiments, such as that shown in FIG. 1, the cushioned, free-spinning roller protective devices (101) may have stabilizer ends (105) at either end of a given cushioned, free-spinning roller protective device (101). Between the stabilizer ends (105) may be a rolling surface region (103). The rolling surface region (103) may be a relatively flat and cylindrical portion of the cushioned, free-spinning roller protective devices (101). In alternative embodiments, the stabilizer ends (105) may be removed or modified. For example, in the embodiments depicted in FIGS. 4 and 5, the cushioned, free-spinning roller protective devices (101) may have a generally hourglass or hyperboloid shape along their major dimension instead of being cylindrical. Alternatively, in the embodiments of FIGS. 2A-2E, the cushioned, free-spinning roller protective devices (101) do not include stabilizer ends (105).

Figure 2A:
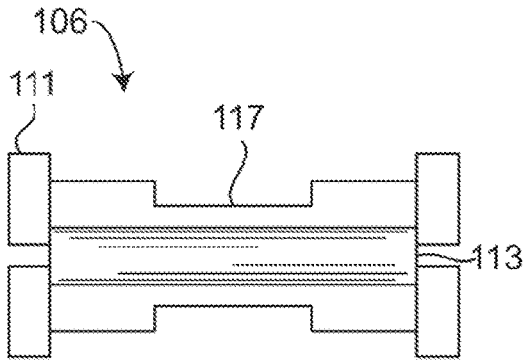
FIG. 2A depicts a side view of a first half of an embodiment of a cushioned, free-spinning roller protective device.
Figure 2B:
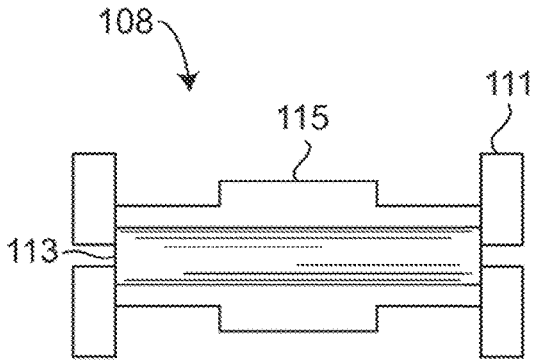
FIG. 2B depicts a side view of a second half of an embodiment of a cushioned, free-spinning roller protective device.

In the embodiment depicted in FIGS. 2A and 2B, in addition to the opening (113) within the cushioned, free-spinning roller protective devices (101) that allows the cushioned, free-spinning roller protective devices (101) to spin on the barbell (11), the depicted embodiment has a grouping of roller wheels (111) mounted to the ends of the cushioned, free-spinning roller protective devices (101). Each of the roller wheels (111) may be mounted to the cushioned, free-spinning roller protective devices (101) by, for example, an axle. The axles may be positioned around the opening (113) at regular or irregular intervals. For example, in some embodiments, the axles are positioned around the opening (113) in a manner that has one, two, or more lines of symmetry.

These roller wheels (111) may contact the barbell (11) and provide a low-friction, rolling surface for the cushioned, free-spinning roller protective devices (101). In the depicted embodiment, each side of the cushioned, free-spinning roller protective devices (101) includes four roller wheels. In other embodiments, more or less roller wheels (111) may be provided. Further, the size and shape of the roller wheels (111) may vary from the depicted embodiments. Generally, the roller wheels (111) will comprise relatively soft and relatively high-friction surfaced wheels having bearings therein along with axles to attach the roller wheels (111) to the cushioned, free-spinning roller protective devices (101).

Figure 2C:
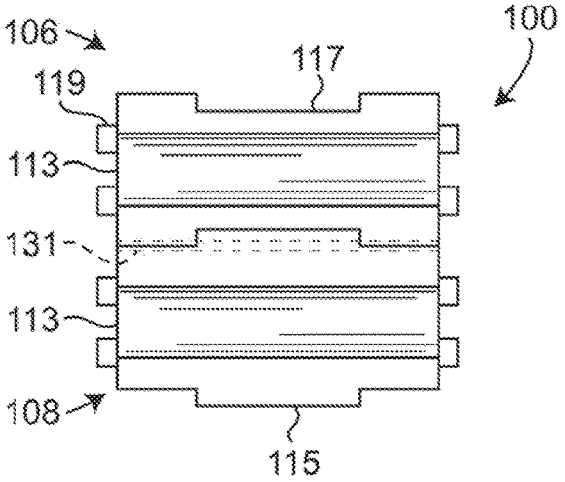
FIG. 2C depicts a side view of a first half partially connected to a second half of an embodiment of a cushioned, free-spinning roller protective device.
Figure 2D:
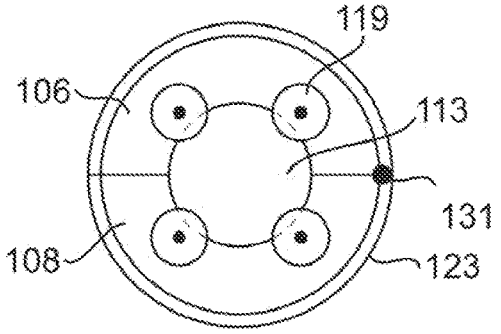
FIG. 2D depicts an alternate side view of a first half fully connected to a second half of an embodiment of a cushioned, free-spinning roller protective device.
Figure 2E:
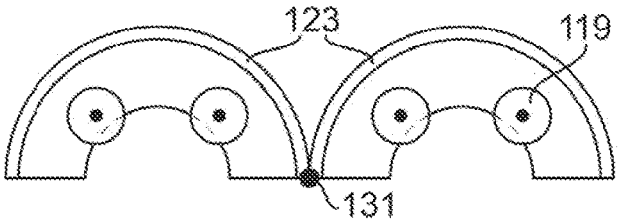
FIG. 2E depicts an alternate side view of a first half partially connected to a second half of an embodiment of a cushioned, free-spinning roller protective device.

The embodiment depicted in FIGS. 2C-2E includes a grouping of small bearings (119) mounted to the ends of the cushioned, free-spinning roller protective devices (101). Each of the small bearings (119) may be mounted to the cushioned, free-spinning roller protective devices (101) by, for example, an axle, similar to the discussion above regarding the roller wheels (111). These small bearings (119) may contact the barbell (11) and provide a low-friction, rolling surface for the cushioned, free-spinning roller protective devices (101). In the depicted embodiments, each side of the cushioned, free-spinning roller protective devices (101) includes four small bearings (111). In other embodiments, more or less small bearings (119) may be provided. Further, the size and shape of the small bearings (119) may vary from the depicted embodiments. The small bearings (119) may include a relatively high-friction surface section or may be provided with only a metal bearing interface.

In other embodiments, large bearings may be used to provide low-friction rotation of the cushioned, free-spinning roller protective devices (101). For example, large bearings may be press fit into the ends of each cushioned, free-spinning roller protective device (101). In such an embodiment, the large bearings will have an inner race diameter that is large enough to fit over the grip portion (102) of a related barbell (11). Accordingly, the large bearings may provide a low-friction connection between the cushioned, free-spinning roller protective devices (101) and the barbell (11).

Figure 3:
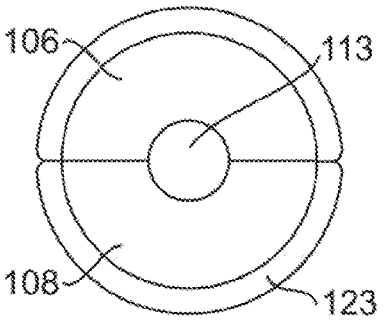
FIG. 3 depicts an alternate side view of a first half fully connected to a second half of an embodiment of a cushioned, free-spinning roller protective device.
Figure 4:
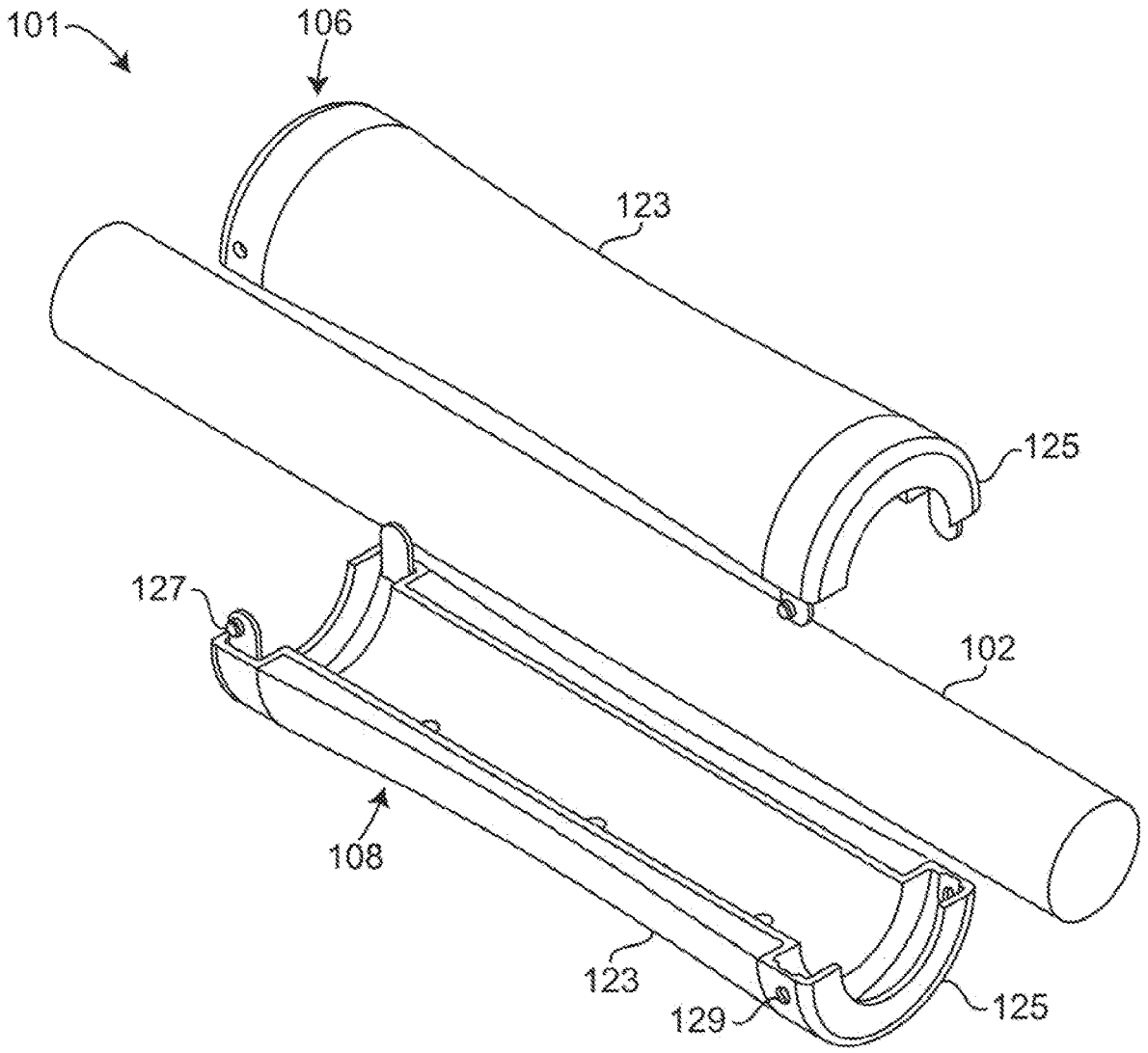
FIG. 4 depicts an exploded perspective view of a first half and a second half of an embodiment of a cushioned, free-spinning roller protective device, along with a related barbell.

The embodiments of the cushioned, free-spinning roller protective devices (101) depicted in FIGS. 2A-2E comprise two halves that may be attached to each other to form an assembled cushioned, free-spinning roller protective device (101). For example, a first half (106) of a cushioned, free-spinning roller protective device (101) is depicted in FIG. 2A, and a second half (108) of a cushioned, free-spinning roller protective devices (101) is depicted in FIG. 2B. The first half (106) includes a recessed portion (117) that is intended to mate with an extended portion (115) of the second half (108). The recessed portion (117) and the extended portion (115) may snap together using, for example, snaps (127) (as depicted in FIG. 4) on one-half that snap into holes (129) (as depicted in FIG. 4) in the other half. In other embodiments, the snaps (127) may be ball snaps, button snaps, or pushpins, much like known ball snaps/detents used to assemble objects, such as, but not limited to, crutches, tent poles, or kayak paddle poles. Such snaps (127) are typically spring-assisted with a bias towards closure or secure attachment. In other embodiments, the snaps (127) may be any form of detent known in the art may be used. In other embodiments, hooks, tabs, hook and loop fastener (e.g. Velcro™), pins, or other securing tools may be used to secure the halves (106) (108) together when assembled. In other embodiments, the two halves (106) (108) may be held together by a friction fit. FIG. 3 depicts a side view of an assembled, cushioned, free-spinning roller protective device (101).

The two halves construction may allow for the cushioned, free-spinning roller protective devices (101) to be assembled around a barbell (11). In other embodiments, each cushioned, free-spinning roller protective device (101) may be formed of a single, integrated unit. In such an embodiment, some feature of the cushioned, free-spinning roller protective device (101) may allow it to be attached to or around a barbell (11). For example, in some embodiments, the cushioned, free-spinning roller protective device (101) may comprise a ring shape that is split at one point on the ring. On a portion of the ring opposite to the split portion may be a flexible section created by, for example, a flexible material or one or more joints built into the ring.

In such an embodiment, the cushioned, free-spinning roller protective device (101) may be placed around a barbell by flexing the ring at the flexible portion and slipping the cushioned, free-spinning roller protective device (101) over the barbell (11). As discussed below, in other embodiments, the flexible portion may be a hinge (131). In yet other embodiments, a single, integrated unit for the cushioned, free-spinning roller protective device (101) may be formed as a continuous, generally cylindrical unit. In such an embodiment, typically the plate-loading portions (15) may be removable to allow the mating of the barbell (11) and the single, integrated, cushioned, free-spinning roller protective devices (101). In particular, in these embodiments, the single, integrated, cushioned, free-spinning roller protective devices (101) may slip over the grip portion (102) of the barbell (11) when the plate-loading portions (15) are removed. The single, integrated, cushioned, free-spinning roller protective devices (101) in these embodiments may lock into place on the grip portion (102) or may just rest over and unattached to the grip portion (102).

FIG. 2C-2E depict an embodiment of the cushioned, free-spinning roller protective devices (101) wherein one side of each of the first half (106) and the second half (108) are secured to each other by a hinge (131). The hinge (131) may include a pin (or pins) that runs through at least a portion of each half. In other embodiments, the hinge (131) may be formed using snaps (127) and holes (129). In these embodiments that include a hinge (131), the other sides of each of the first half (106) and the second half (108) may be secured together using any means discussed above or known in the art. FIG. 2D depicts a side view of an embodiment of an assembled, cushioned, free-spinning roller protective device (101) wherein the first half (106) and the second half (108) are secured to each other on both sides. FIG. 2E depicts a side view of an embodiment of an open, unassembled, cushioned, free-spinning roller protective device (101) wherein the first half (106) and the second half (108) are secured to each other on one side by a hinge (131) and unsecured on the other side. Further. FIGS. 2C-2E shows that the cushioned, free-spinning roller protective device (101) may be covered by a cushioning material (123).

Figure 5:
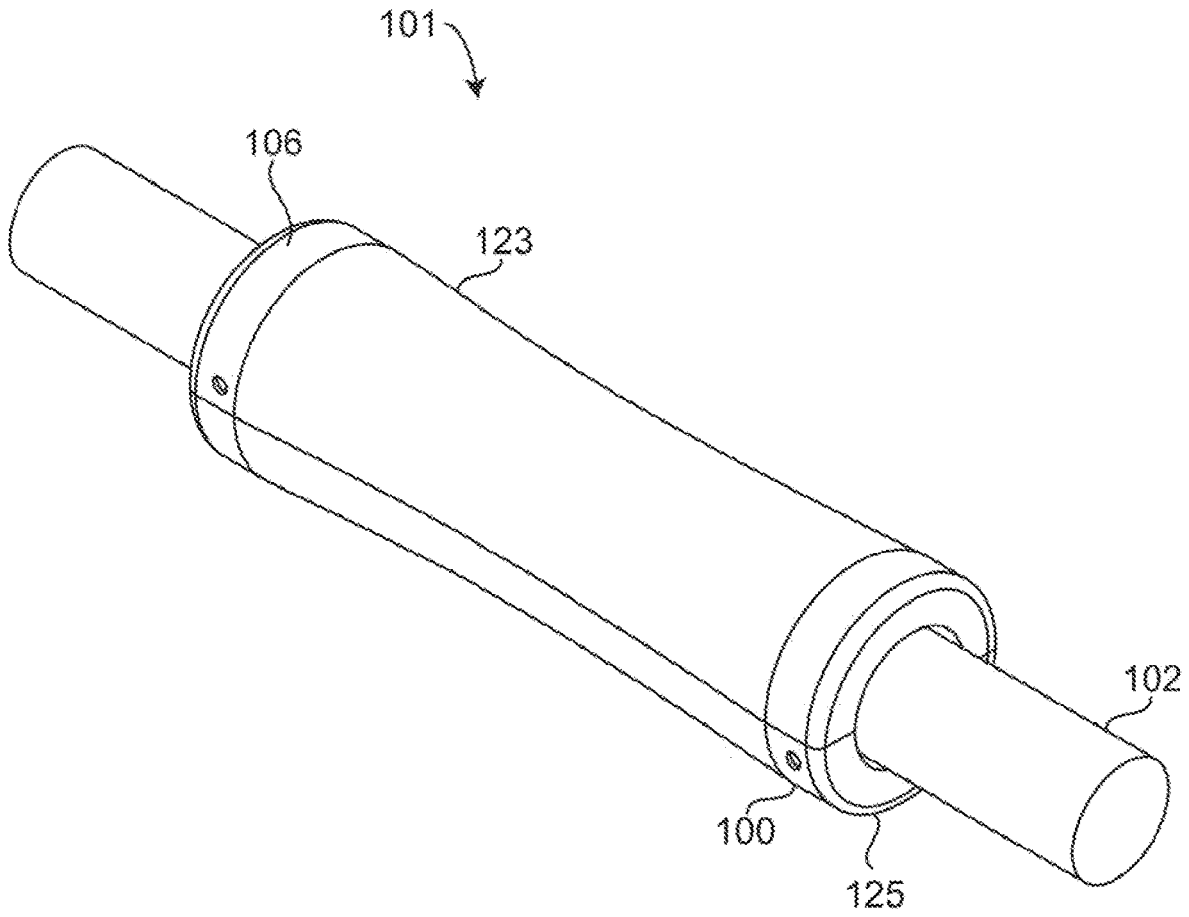
FIG. 5 depicts a perspective view of a first half and a second half of an embodiment of a cushioned, free-spinning roller protective device, along with a related barbell.

The embodiment depicted in FIGS. 4 and 5 depicts an additional embodiment of the cushioned, free-spinning roller protective device (101) wherein each end of the cushioned, free-spinning roller protective device (101) is flared outwards to have a larger overall diameter giving it a generally hourglass shape. As depicted, the first half (106) and second half (108) may be designed to fit together over the barbell (11). Further, FIGS. 4 and 5 provide additional detail on the construction of the first half (106) and the second half (108). Both halves (106)(108) may include a lower layer (125) that is formed of a resilient material. For example, this resilient material may be any plastic, polymer, metal, or other material that is capable of withstanding the forces of being dragged against a weightlifter's shins during a deadlift. Further, both halves may include a cushioning material (123). The cushioning material (123) may be a plastic, polymer, foam, felt, rubber, or any other material that is capable of providing cushioning for a weightlifter's shins that is also compatible with being formed over the lower layer (125). The lower layer (125) and the cushioning material (123) may be formed using any suitable processes. For example, the lower layer (125) and the cushioning material (123) may be co-molded. In other embodiments, the cushioning material (123) may be glued, taped, connected, press fitted, or otherwise fastened, joined, fixed, or secured to the lower layer (125) using any technique known in the art or later discovered.

The placement of the cushioned, free-spinning roller protective devices (101) onto a barbell (11) may vary based on, for example, the type of deadlift the weightlifter desires to perform. For example, for a standard deadlift, the weightlifter's shins remain relatively in plane when performing a deadlift. However, during a sumo style deadlift, wherein a weightlifter begins a deadlift with knees bent and feet placed wide apart, the weightlifter's shins begin in a vertical plane but move into angled planes relative to vertical as the deadlift is completed. This change in shin placement may require the use of longer or otherwise adjusted cushioned, free-spinning roller protective devices (101). For example, these cushioned, free-spinning roller protective devices (101) may need to be placed closer to the weight plates (13) than in situations where the weightlifter is performing a standard deadlift. Further, the end portions of the cushioned, free-spinning roller protective devices (101) may be tapered or otherwise designed to ensure a smooth transition of the barbell (11) from the weightlifter's shins onto their thighs during a sumo style deadlift. Again, the cushioned, free-spinning roller protective devices (101) may traverse the barbell (11) along their primary axis during the sumo style deadlift.

In other embodiments of the system (100), the cushioned, free-spinning roller protective devices (101) may be integrated into the barbell (11). For example, the barbell (11) may include a grooved section (or sections) on the grip portion (102) that allows for mating regions of the cushioned, free-spinning roller protective devices (101) to lock onto the barbell (11). As discussed above, in some embodiments, the plate-loading portions (15) may be removable to allow the mating of the barbell (11) and the cushioned, free-spinning roller protective devices (101). In other embodiments, the cushioned, free-spinning roller protective devices (101) may be formed in halves and attachable directly to the grip portion (102). In any embodiment, the cushioned, free-spinning roller protective devices (101) may be attached at any point along the grip portion (102). Further, in any embodiment, the cushioned, free-spinning roller protective devices (101) may be fastened to the barbell (11) using any device known in the art, including without limitation screws.

In other embodiments, the cushioned, free-spinning roller protective devices (101) may be designed to allow bending in the barbell (11), which bending may occur during deadlifts involving significant weight. In such an embodiment, the cushioned, free-spinning roller protective devices (101) may be formed to include multiple sections. Each section may include a lower layer (125) that is formed of a resilient material and separated from the lower layers (125) of adjacent sections. Further, each section may have a cushioning material (123). In some embodiments, the sections will be connected by an articulating or otherwise flexible connection. Further, the cushioning material (123) may be a continuous piece of flexible material that extends across all sections and connections. In other embodiments, the cushioning material (123) may be separate pieces of material attached to each section, wherein the cushioning material (123) from adjacent sections extend past each section to a sufficient extent to cover the connections. In any case, such an embodiment of cushioned, free-spinning roller protective devices (101) will be capable of flexing along with a flexing barbell (11) while maintaining sufficient cushioning for a weightlifter's shins.

While the invention has been disclosed in conjunction with a description of certain embodiments, including those that are currently believed to be useful embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

It will further be understood that any of the ranges, values, properties, or characteristics given for any single component of the present disclosure can be used interchangeably with any ranges, values, properties, or characteristics given for any of the other components of the disclosure, where compatible, to form an embodiment having defined values for each of the components, as given herein throughout. Further, ranges provided for a genus or a category can also be applied to species within the genus or members of the category unless otherwise noted.

Finally, the qualifier "generally," and similar qualifiers as used in the present case, would be understood by one of ordinary skill in the art to accommodate recognizable attempts to conform a device to the qualified term, which may nevertheless fall short of doing so. This is because terms such as "cylindrical" are purely geometric constructs and no real-world component is a true "cylindrical" in the geometric sense. Variations from geometric and mathematical descriptions are unavoidable due to, among other things, manufacturing tolerances resulting in shape variations, defects and imperfections, non-uniform thermal expansion, and natural wear. Moreover, there exists for every object a level of magnification at which geometric and mathematical descriptors fail due to the nature of matter. One of ordinary skill would thus understand the term "generally" and relationships contemplated herein regardless of the inclusion of such qualifiers to include a range of variations from the literal geometric meaning of the term in view of these and other considerations.

The invention claimed is:

1. A protective device for use with a barbell, the device comprising:

a main body generally in the shape of a cylindrical shell having a primary axis, the main body including an inner hole along said primary axis configured for placement over a barbell, wherein said main body can separate into two pieces, the plane of separation including said primary axis; and a plurality of rollers positioned within said inner hole and configured to allow said main body to rotate about said barbell around said primary axis.

2. The device of claim 1 wherein said rollers comprise bearings.

3. The device of claim 1 wherein said rollers comprise wheels.

4. The device of claim 1 wherein said two pieces snap together.

5. The device of claim 1 wherein said two pieces are hinged together.

6. The device of claim 1 wherein a lower layer of said cylindrical shell about said hole is a resilient material and an upper layer is a cushioned layer.

7. The device of claim 1 further comprising two stabilizer ends, one of said two stabilizer ends being positioned at opposing ends of said cylindrical shell along said primary axis.

8. A protective device for use with a barbell, the device comprising:

a main body generally in the shape of an hourglass having a primary axis, the main body including an inner hole along said primary axis configured for placement over a barbell, wherein said main body can separate into two pieces, the plane of separation including said primary axis; and a plurality of rollers positioned within said inner hole and configured to allow said main body to rotate about said barbell around said primary axis.

9. The device of claim 8 wherein said rollers comprise bearings.

10. The device of claim 8, wherein said rollers comprise wheels.

11. The device of claim 8 wherein said two pieces snap together.

12. The device of claim 8 wherein said two pieces are hinged together.

13. The device of claim 8 wherein a lower layer of said cylindrical shell about said hole is a resilient material and an upper layer is a cushioned layer.

14. A barbell configured for use in a deadlift, the barbell comprising:

two plate-loading portions with a grip portion therebetween;

at least one weight plate loaded onto each of said plate-loading portions; and two protective devices positioned on said grip portion, each of said protective devices comprising:

a main body generally in the shape of a cylindrical shell having a primary axis, the main body including an inner hole along said primary axis configured for placement over a barbell, wherein said main body can separate into two pieces to separate said protective devices from said barbell, the plane of separation including said primary axis; and a plurality of rollers positioned within said inner hole and configured to allow said main body to rotate about said barbell around said primary axis.

15. The barbell of claim 14 wherein said protective devices are positioned on said grip portion so as to contact a user's shins when said barbell is used in a deadlift.

16. The barbell of claim 14 wherein said protective devices traverse at least a portion of said grip portion when said barbell is used in a deadlift.

17. The barbell of claim 14 wherein said protective devices are integrated into said barbell.

* * * * *